United States Patent [19]

Desai

[11] 3,973,870

[45] Aug. 10, 1976

[54] INTERNAL MOISTURE REMOVAL SCHEME FOR LOW PRESSURE AXIAL FLOW STEAM TURBINE

[75] Inventor: Kirit J. Desai, Media, Pa.

[73] Assignee: Westinghouse Electric Corporation, Pittsburgh, Pa.

[22] Filed: Nov. 4, 1974

[21] Appl. No.: 520,830

[52] U.S. Cl. ..... 415/168; 415/121 A

[51] Int. Cl.[2] ..... F01D 25/32

[58] Field of Search ..... 415/121 A, 168; 416/190, 236 A, 236 R

[56] References Cited

UNITED STATES PATENTS

| | | | |
|---|---|---|---|
| 1,829,674 | 10/1931 | Rosenlocher | 415/168 |
| 1,862,827 | 6/1932 | Parsons et al. | 415/168 |
| 1,864,803 | 6/1932 | Clark | 416/236 |
| 1,943,934 | 1/1934 | Telfer | 416/236 |
| 3,014,640 | 12/1961 | Barney et al. | 415/168 |
| 3,290,004 | 12/1966 | Ishibashi | 416/190 |
| 3,301,529 | 1/1967 | Wood | 415/168 |
| 3,304,056 | 2/1967 | Sohma | 415/168 |
| 3,720,045 | 3/1973 | Murphy | 415/168 |

FOREIGN PATENTS OR APPLICATIONS

| | | | |
|---|---|---|---|
| 547,332 | 3/1932 | Germany | 415/168 |
| 681,479 | 9/1939 | Germany | 416/236 |
| 233,693 | 4/1969 | U.S.S.R. | 416/168 |

*Primary Examiner*—Henry F. Raduazo
*Attorney, Agent, or Firm*—G. H. Telfer

[57] ABSTRACT

A moisture removal scheme for an axial flow turbine apparatus is disclosed. A substantially radial groove disposed on a rotating blade conducts moisture droplets deposited on the blade in a radial direction toward a circumferential slot disposed on the interior surface of a turbine casing. The slot is radially adjacent to the radial outermost point of the groove and collects moisture thrown thereinto from the groove to eliminate that moisture from the interior of the turbine. Axial ridges are provided on the blade to guide the moisture droplets deposited thereon into the radial groove.

4 Claims, 2 Drawing Figures

INTERNAL MOISTURE REMOVAL SCHEME FOR LOW PRESSURE AXIAL FLOW STEAM TURBINE

BACKGROUND OF THE INVENTION

1. Field of the Invention

This invention relates to a low pressure axial flow steam turbines, and in particular, to a scheme for removing moisture carried by the steam flow within a low pressure turbine apparatus.

2. Description of the Prior Art

As is well known to those skilled in the art of steam power generation, one of the major problems associated with low pressure wet steam turbine utilized in nuclear power plants is the control of the increasing amount of moisture created as the motive steam expands through the turbine apparatus. Since the presence of excessive moisture carried by the axial flow increases erosion damage to rotating blades and also reduces the thermal efficiency of the apparatus, it is highly desirable to remove condensed steam droplets carried by the steam flow or else to minimize their effects.

In order to inhibit damage to the rotating blades, it is the practice in the prior art to dispose a coating or a strip of hard material, such as Stellite, on the backside of each of the rotating blades usually in the last and next to last rotating blade arrays. It is these rotating blades which undergo the most severe erosion damage since, at this point in the turbine, the moisture carried by the steam has agglomerated to a drop size of sufficient mass that it cannot be accelerated through the small axial clearance between the stationary and rotating blades and thus impinges upon the backside of the rotating blades. The incessant bombardment of the backside of rotating blades by these relatively massive water droplets severely damages the blades. Erosion damage of such severity has been documented that the damaged air foil is nearly severed from the remainder of the blade adjacent the blade tip. However, provision of erosion resistant material, such as Stellite, is expensive, and often tends to weaken the rotating blades.

An alternative method for controlling the effects of condensate by modification of the rotating blades is shown in U.S. Pat. No. 3,290,004, issued to Ishibashi, which provides radially extending grooves on the backside of the rotating blades. Also, a similar rotating blade has been disclosed in General Electric Company 1969 Presentation to the American Edison Illuminating Companies.

Other moisture removal schemes have heated the stationary blades to prevent the agglomeration thereon of larger more massive water drops. By providing a heated outer coating on the stationary blades, the fine fog droplets carried by the steam flow are discouraged from being deposited on the stationary blades, thus drops of the size sufficient to damage the rotating blades are not able to form. Another technique is disclosed and claimed in U.S. Pat. No. 3,724,967, issued to Frederick K. Fischer and assigned to the assignee of the present invention. Fischer disposes interconnecting cavities in the base portion of the stationary blades which communicates with ports on the surface of the blade and which removes steam and water from the surface of the stationary blades separate the steam and water phases, and direct the steam toward the rotating blades downstream thereof and water to an appropriate drain.

In addition to these above-mentioned internal moisture-removal devices, the prior art has disclosed moisture separation elements external to the turbine. For example, an external moisture-separator element is often disposed in the crossover line between the high and low pressure turbine elements in nuclear power plants. As another example, steam is often reheated after it has been partially expanded through the high pressure element by adding thereto heat taken from throttle steam. However, these external methods are often cumbersome and require significant amounts of external piping which, adds to the cost and the space requirements of the power plant.

SUMMARY OF THE INVENTION

This invention discloses a moisture control scheme for an axial flow turbine apparatus. A plurality of substantially radial grooves is disposed on a concave surface of an air foil portion of a rotating blade adjacent the trailing edge thereof. The grooves extend on the table throughout the radial length of the air foil and terminate radially adjacent to the circumferentially extending slot disposed on the interior of the outer casing. Moisture deposited on a concave surface of the rotating blades is conducted into the radial grooves and then carried radially outward in the grooves and under the influence of centrifugal force until the water is thrown into the circumferential slot in the casing. The water thrown into the slot is extracted therefrom by suitable means. Axially extending ridges are provided on the concave surface of the blade to assist in guiding the water deposited through-out the entire radial height of the blade into the substantially radial grooves.

It is an object of this invention to provide a scheme for removing moisture from rotating blades in an axial flow turbine apparatus. It is a further object of this invention to dispose on rotating blades of an axial flow turbine apparatus of substantially radially extending grooves which conducts water carried in the groove into a circumferential slot disposed on the interior of the turbine casing. It is desirable, and therefore a further object of this invention, to remove water from an axial steam flow within a turbine apparatus at a point within the turbine apparatus before the water is permitted to agglomerate to a size sufficient to cause severe erosion damage to rotating blades within the turbine apparatus.

BRIEF DESCRIPTION OF THE DRAWINGS

The invention will be more fully understood from the following detailed description taken in connection with the accompanying drawings, in which.

DESCRIPTION OF THE PREFERRED EMBODIMENT

Figure 1:
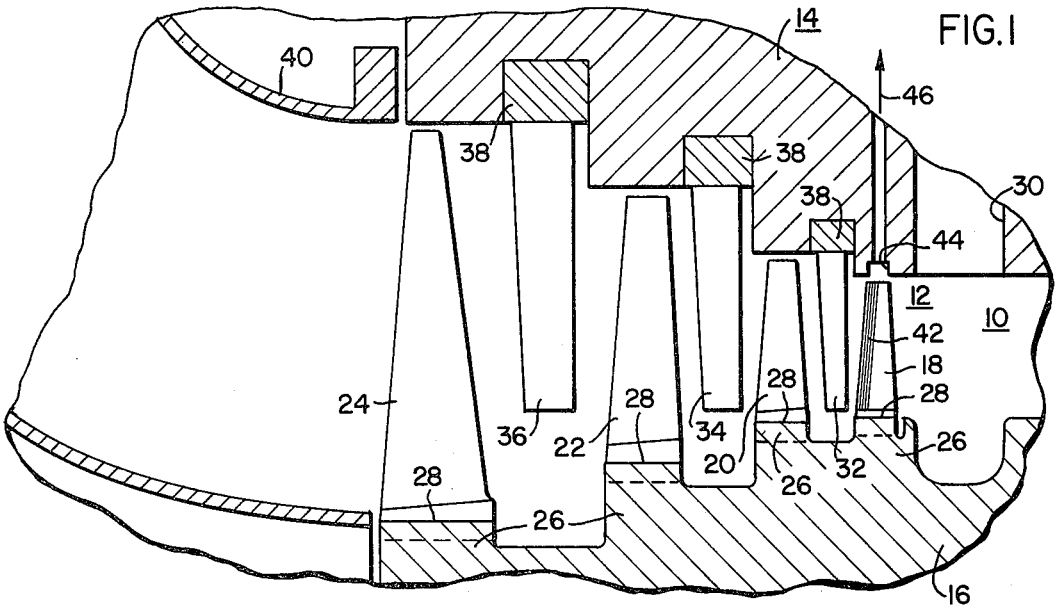
FIG. 1 is an elevational view, in section, of a portion of the blade path of a low pressure, axial flow turbine apparatus embodying the teachings of this invention.

Throughout the following descriptions similar reference characters refer to similar elements in all Figures of the drawings.

Referring first to FIG. 1, an elevational view, in section, of a low pressure axial flow elastic fluid turbine apparatus 10 having an internal moisture separating means generally indicated by reference numeral 12 is shown. The turbine 10 comprises a cylindrical outer casing 14 surrounding and rotatably supporting a rotor element 16 on suitable bearing members (not shown). Mounted on the rotor 16 is a plurality of arrays of rotating blades indicated in FIG. 1 by reference numerals 18, 20, 22 and 24. Each blade and each rotating blade array is affixed to disc members 26 mounted on the rotor member 16 by a serrated root portion 28. The roots 28 are commonly side entry "fir-tree" roots which slidably engage a generally axial opening disposed in the discs 26. The array of rotating blades 18 lies closest to the inlet 30 of the turbine 10 and will be hereafter designated as the first array of rotating blades. The array of rotating blades 20 will hereinafter be designated as the second rotating blade array while the array 22 will be designated as the next-to-last array of rotating blades, with the array 24 being designated as the last rotating array.

Axially intermediate between each adjacent array of rotating blades is an array of stationary blades, or nozzles 32, 34 and 36, each of the stationary nozzle blades being secured to an annular diaphragm ring 38 which is in turn affixed in predetermined positions within the casing 14. The stationary blades are disposed a predetermined axial spacing between adjacent arrays of rotating blades and direct the elastic fluid entering the turbine through the inlet 30 onto each succeeding array of rotating blades so as to most efficiently extract and convert the energy carried by the steam into rotational mechanical energy.

The pressure of the motive fluid is greatest within the turbine 10 adjacent the inlet 30 thereof. The motive fluid impinges upon the alternately placed rotating and stationary blades as the fluid expands through the interior of the casing 14 from the inlet 30 toward a flow guide 40 located axially downstream of the last rotating blade row 24.

One of the problems associated with low pressure apparatus utilized in a nuclear steam power plant is the control of condensate created by the expansion of the elastic fluid through the low pressure apparatus 10. This condensate, which is in the form of fine water droplets carried by the axial steam flow, is deposited upon the stationary blades within the turbine 10 and through various physical mechanism agglomerates into large droplets. These droplets are torn from the stationary blades by the axial steam flow and cause severe erosion damage to rotating blades disposed in the last and the next to the last rotating blade arrays.

The prior art offered various solutions to this problem. For example, each rotating blade in last and next to the last rotating blade arrays was coated or provided with a corrosion resistant material disposed on the backside of each blade. This corrosion resistant material, commonly Stellite, is expensive, and tends to weaken the blades. In addition, erosion damage was only delayed but not prevented by the application of a Stellite layer. Other examples include that shown in the General Electric Company 1969 Presentation to American Edison Illuminating Company and that shown in U.S. Pat. No. 3,290,004.

In general, the moisture control scheme 12 shown in FIG. 1 comprises a plurality of substantially radial grooves 42 disposed on each rotating blade within the first rotating blade array 18. The grooves 42 extend radially along the air foil portion of each rotating blade and lie radially adjacent to a circumferential slot 44 disposed above the interior of the casing 14. The grooves 42 conduct water droplets which are disposed on the rotating blades in the rotating blade array 18 radially outward under the influence of centrifugal force and throw the droplets so conducted into the removal slot 44. The removal slot 44 itself may be connected to a steam extraction line or else directly to the condenser element (not shown), as indicated diagrammatically by reference numeral 46. By disposing this moisture control scheme at a position within the low pressure turbine element before the steam flow becomes more significantly moisture-laden, it is possible to eliminate from the axial steam flow a significant percentage of water droplets which could agglomerate into large sized drops if they were permitted to expand and to be carried by the steam flow onto other rotating and stationary blade arrays downstream of the first rotating blade array 18. It is to be understood, however that although FIG. 1 discloses the moisture control means 12 as applied to the first rotating blade array 18 within the low pressure turbine 10, the device taught by this invention may be disposed on any predetermined number of rotating blade arrays at any predetermined axial location within the low pressure turbine apparatus 10. It is usually advantageous to begin the process of internal moisture separation at that axial position within the low pressure apparatus 10 at which the moisture content carried by the axial flow of motive fluid approaches 3 to 4%. It is, of course, within the contemplation of this invention to disclose the moisture control means 12 on more than one array of rotating blades within the turbine apparatus 10. By eliminating a significant percentage of the moisture from the axial steam flow before it further expands through the low pressure apparatus 10, it is possible to limit the deleterious effects of erosion damage caused by the impingement of agglomerated water droplets on the last and next to the last rotating blade arrays.

Figure 2:
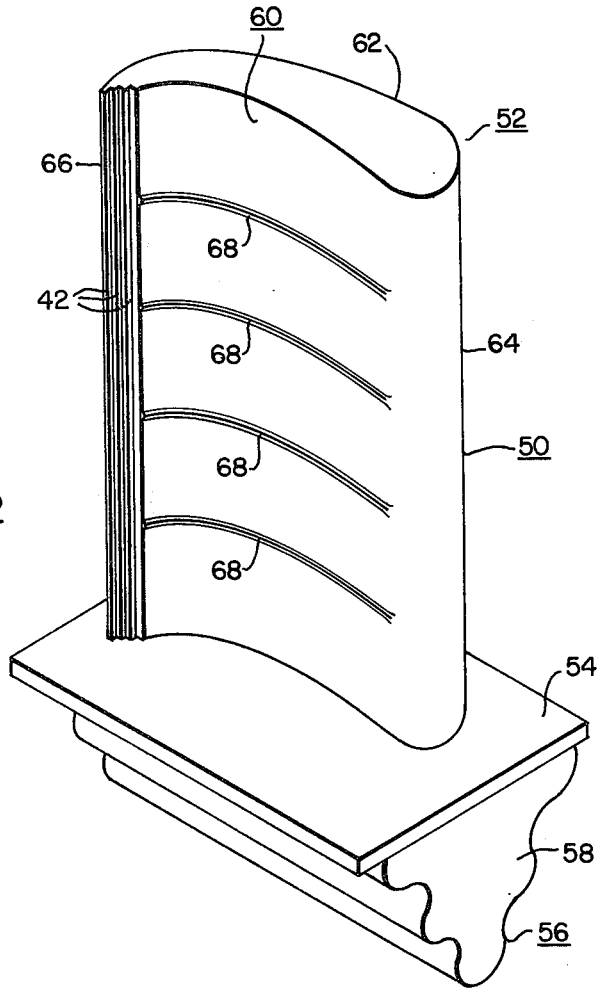
FIG. 2 is a perspective view of a rotating blade embodying the teachings of this invention.

Referring now to FIG. 2 a rotating blade 50 having disposed thereon the substantially radial grooves 42 is shown in a perspective illustration. As is seen from FIG. 2, the blade 50 is comprised of an air foil portion 52 extending radially outward from a platform portion 54 which is integral with a fir-tree root 56. The fir-tree root has a plurality of tangs 58 which provide the root with a serrated cross-section. The tangs 58 are slidably engaged within the substantially axial slot disposed on the disc 26 mounted on the rotors 16 (FIG. 1).

The air foil portion has a concave and a convex surface reference numerals 60 and 62 respectively thereon. In FIG. 2, the concave surface 60 is visible. The air foil 52 also has a leading edge 64 and a trailing edge 66. The leading edge 64 is disposed in the turbine apparatus 10 so that the pressure of the motive fluid is higher adjacent the leading edge 64 than the pressure of the motive fluid adjacent the trailing edge 66. The plurality of radial grooves 42 is disposed, according to the teachings of this invention, on the concave surface 60 of the air foil portion 52 adjacent the trailing edge 66 thereof. It has been empirically established that the concave surface 60 is the surface whereon most moisture carried by the axial flow of steam is collected and deposited. By providing the series of radial grooves 42 on the concave surface 60 of the air foil portion 52 near the trailing edge 66 thereof the collected moisture along the entire radial height of the air foil 52 can be impelled by the axial flow of steam into the plurality of grooves 42. Once the moisture droplets have been conducted into the groove 42, centrifugal force imposed upon the water droplets within the grooves 42 by the rotation of the rotor members 16 impels the water droplets within the grooves 42 toward the radial outermost portion of the air foil 52. In order to assist collection of the deposited moisture within the grooves 42, a plurality of spoilers, or ridges, 68 is disposed in a substantially axial direction on the concave surface 60 of the air foil portion 52. The spoilers 68 are smooth, ridge-like projections and assist in guiding water deposited on the concave surface 60 of the blade 50 into the slots 42. It is to be noted that moisture deposited along the entire radial height of the concave surface 60 on the air foil 52 through the agency of the grooves 42 and the spoilers 68 becomes centrifuge towards the radial outermost tip of the blade 50 and is then thrown into the radially adjacent groove 44 circumferentially disposed on the interior of the casing 14. The moisture thrown into the groove 44 is extracted by suitable extraction means as indicated by numeral 46.

In the absence of the groove 42 and spoilers 68 on the concave surface 60 of the air foil 52, the moisture on this surface from approximately the platform portion to the 3¼ blade height region is thrown from the blade under the influence of axial and radical forces imposed on the moisture by the axial steam flows before the deposited moisture reaches the blade tip. Thus, the moisture continues to be entrained within the steam flow and becomes deposited upon the next adjacent stationary blade 32 where the agglomeration process continues and becomes increased. The scheme disclosed by the teachings of this invention insures that this otherwise entrained moisture is centrifuged while within the grooves 42 to the blade tip where it is deposited directly into the removal slot 44 in the turbine casing, thereby removing completely this moisture from the axial steam flow. Of course, if the grooves taught by this invention were disposed on more than the first array of rotating blades, similar elimination through to the agency of the spoilers, grooves and the circumferential slot would eliminate a significant percentage of the moisture carried by the expanding axial flow of steam and thus eliminate the source of water droplets which in the prior art agglomerate into large sized water drops which cause severe erosion damage to the rotating blades in the last and the next to the last rotating blade array. As apparent from the foregoing discussion, one advantage of the disposition of radial grooves 42 and the circumferential slot 44 disposed radially adjacent to the outermost tip thereof is the simplicity and low cost. Since the extraction device disclosed herein is part of the turbine blade and the interior of the turbine casing itself, no external piping and external elements are required, thereby incurring no increased cost or space requirements for the power plant. Further, moisture carried by the steam flow is removed therefrom as soon as it begins to be deposited and collected on the concave surface of the blades, thereby limiting the deleterious effects of agglomerated water droplets on the rotating blade arrays axially downstream. Further, moisture is eliminated, due to the disposition of the spoiler 68, throughout the entire height of the air foil 52 and not merely within the blade tip region. The disposition of the grooves 42 and the spoilers 68 have been shown by laboratory experimentation to have no appreciable effect on the flow of motive fluid through the blades. This is so because the depth of each groove 42, approximately 0.02 inches, is substantially equal to the boundary layer thickness on the concave surface of typical low pressured turbine blades. Similarly, spoilers 68 have little or no measurable effect on the flow through the blade. Experience has indicated that the total blockage area of the spoilers 68 is approximately 15% of the blockage incurred by the typical lashing wire utilized on a low pressure blade.

In addition to eliminating from the axial steam flow any moisture created from as the steam expands through the turbine, application of teachings of this invention results in a substantial improvement in the heat rate of the turbine. Thus, in addition to limiting moisture and erosion damage caused thereby, substantial heat rate improvements can be effected by utilization of the teachings of this invention.

It is also within the contemplation of this invention to dispose a plurality of substantially radially grooves near the trailing edge 66 of a rotating blade on the convex side 62 thereof.

I claim as my invention:

1. An axial flow turbine apparatus comprising:

a casing having a slot circumferentially disposed about the interior surface thereof for the removal of moisture, a rotor member rotatably supported within said casing, a rotatable blade mounted on said rotor member for rotation therewith, said rotatable blade having a convex surface, a concave surface, a leading edge and a trailing edge thereon, a radially extending groove disposed on said concave surface adjacent to said trailing edge in radial alignment with said slot, an axially extending ridge disposed on said concave surface, said ridge terminating adjacent to said groove, said ridge adapted to guide moisture droplets carried by a motive fluid and deposited on said concave surface into said groove, said groove adapted to conduct moisture droplets guided thereinto by said ridge into said circumferentially extending slot in said casing.

2. The turbine of claim 1, wherein said blade has a platform thereon and an airfoil portion extending radially outward from said platform, said airfoil terminating in a blade tip, said groove being radially coextensive with said airfoil portion.

3. The turbine of claim 2, wherein a plurality of radially extending grooves are disposed on said convex surface adjacent said trailing edge of said rotatable blade.

4. The turbine of claim 3, wherein a plurality of axially extending ridges are disposed on said concave surface of said rotatable blade, each of said ridges terminating adjacent said plurality of grooves, said plurality of ridges adapted to guide moisture droplets deposited on said concave surface by said motive fluid into said plurality of radially extending grooves, said plurality of radially extending grooves each being substantially coextensive with said airfoil portion of said blade and adapted to conduct said moisture droplets guided thereinto by said ridges into said slot extending circumferentially about the interior of said casing.

* * * * *